United States Patent [19]

Sullaway

[11] 4,220,422

[45] Sep. 2, 1980

[54] LEG CLOSURE

[75] Inventor: Bob L. Sullaway, Duncan, Okla.

[73] Assignee: Halliburton Company, Duncan, Okla.

[21] Appl. No.: 914,468

[22] Filed: Jun. 12, 1978

[51] Int. Cl.[2] ..... B63C 23/16; E02D 5/52

[52] U.S. Cl. ..... 405/225; 405/227

[58] Field of Search ..... 405/195–209, 405/224–228; 38/89, 90

[56] References Cited

U.S. PATENT DOCUMENTS

| | | | |
|---|---|---|---|
| 1,696,435 | 12/1928 | Fraley | 285/229 |
| 2,998,986 | 9/1961 | Buono | 285/229 |
| 3,139,115 | 6/1964 | Bawcom et al. | 285/229 X |
| 3,191,950 | 6/1965 | Hiltner | 277/235 X |
| 3,305,251 | 2/1967 | Skinner | 285/229 |
| 3,533,241 | 10/1970 | Bowerman et al. | 61/63 X |
| 3,666,296 | 5/1972 | Fischetti | 285/229 X |
| 3,868,826 | 4/1975 | Landers | 61/102 |
| 4,047,391 | 9/1977 | Mayfield et al. | 61/94 |
| 4,124,988 | 11/1978 | Landers | 405/228 |

*Primary Examiner*—Dennis L. Taylor

*Attorney, Agent, or Firm*—James R. Duzan; John H. Tregoning

[57] ABSTRACT

A diaphragm for closing the bore of a tubular piling guide member and/or supporting leg member of a marine platform or similar structure, the diaphragm comprising reinforced elastic material wrapped around and bonded to a plurality of reinforcing members in the diaphragm with the diaphragm being positively secured to the guide member and/or leg of the platform by means of two flat annular plates having fasteners retaining the diaphragm therebetween.

12 Claims, 4 Drawing Figures

LEG CLOSURE

This invention relates to improved closure diaphragms for offshore platforms used in well drilling and production.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into the subterranean formations below the ocean floor to anchor the platform in position.

It is desirable during platform setting operations to exclude foreign material from the platform leg to prevent the annulus between the piling and platform leg from becoming contaminated with foreign material which would prevent filling of the annulus with cement or grout. Therefore, a closure structure which is easily severable when the piling is driven through the platform leg is used to seal the end of the platform leg during setting of the platform.

One type of prior art leg closure as illustrated in U.S. Pat. No. 3,533,241 comprises a circular diaphragm of reinforced elastic material having an annular reinforcing element of circular cross-sectional shape molded in the periphery of the diaphragm with the diaphragm being secured to the leg of the platform by means of two annular plates, each plate having an annular groove of semi-circular cross-sectional shape therein for confining the annular reinforcing element in the periphery of the diaphragm between the two annular plates. The semi-circular grooves in the two annular plates are of slightly less radial diameter than the periphery of the diaphragm having the annular reinforcing element therein to confine the diaphragm periphery between the two annular plates by slightly deforming it. The reinforcing plies in the diaphragm are alternately wrapped and bonded about the reinforcing element in the periphery of the diaphragm to form a bead of circular cross-sectional shape about the diaphragm periphery without the ends of the plies extending into the inner portion of the diaphragm.

While the leg closure illustrated in U.S. Pat. No. 3,533,241 is of simple construction, the leg closure requires the two annular plates have the semi-circular grooves machined therein which for large diameters of leg closures can be difficult and requires the plies having the reinforcing cords therein be alternately wrapped and bonded about the annular reinforcing member which can cause handling problems during molding of the leg closure.

Another type of leg closure as illustrated in U.S. Pat. No. 4,024,723 comprises a circular diaphragm of reinforced elastic material having an annular reinforcing element being of a teardrop cross-sectional shape molded in the periphery of the diaphragm and having a ring of downwardly facing cutter blades molded in the upper surface of the diaphragm to sever the diaphragm when a piling is driven therethrough with the diaphragm being secured to the leg of the platform by means of two annular plates with one plate having an annular groove therein for confining the annular reinforcing element in the periphery of the diaphragm between the two annular plates.

While the leg closure of U.S. Pat. No. 4,024,723 is relatively simple to construct, it requires the addition of cutter blades to be molded in the leg closure which offer resistance when driving the piling through the leg closure and requires the machining of a circular cross-sectional shaped groove in at least one of the two annular plates securing the diaphragm to the leg or sleeve.

In contrast to the prior art leg closures, the leg closure of the present invention comprises a diaphragm of reinforced elastic material wrapped and bonded about one or more reinforcing members in the periphery of the diaphragm with the diaphragm being secured to the leg of the platform by means of two annular plates with the annular plates either having flat confronting faces which have fasteners retaining the diaphragm therebetween via holes therein or having flat confronting faces with inwardly tapered enlarged ends to retain the leg closure therebetween by means of an interference fit therewith.

The advantages and the preferred embodiments of the present invention will be understood from the following specification taken in conjunction with the accompanying drawings wherein.

Figure 1:
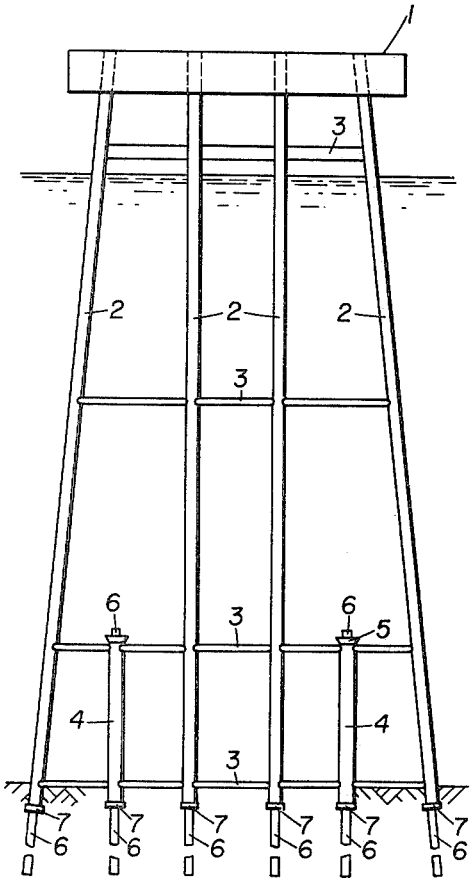
FIG. 1 is a side elevational view of a marine drilling platform having tubular supporting legs and piling guides between the legs resting on the bottom of a body of water with the present invention installed on the lower end of the legs and guides.

Referring to FIG. 1, the present invention is shown installed on a marine platform. A marine platform 1 having tubular supporting legs 2 between which horizontal reinforcing members 3 are connected in the usual manner. Tubular piling guides or piling sleeves 4, which may have flared upper ends 5, are supported between the lower end portion of the legs 2 by the lower reinforcing members 3 and, with the legs, are adapted to rest upon or have their lower extremities slightly embedded in the bottom of a body of water.

The guides 4 or legs 2 are secured to the earth by driving piling 6 to refusal into the bottom of the body of water. Upon completion of the pile driving, the annulus between each guide 4 and/or leg 2 and its associated piling 6 may be filled with cement or grout to provide a unitary base structure.

Contained on the bottom of each leg 2 and guide 4 is a rupturable seal assembly 7 which embodies the principles of the present invention.

Figure 2:
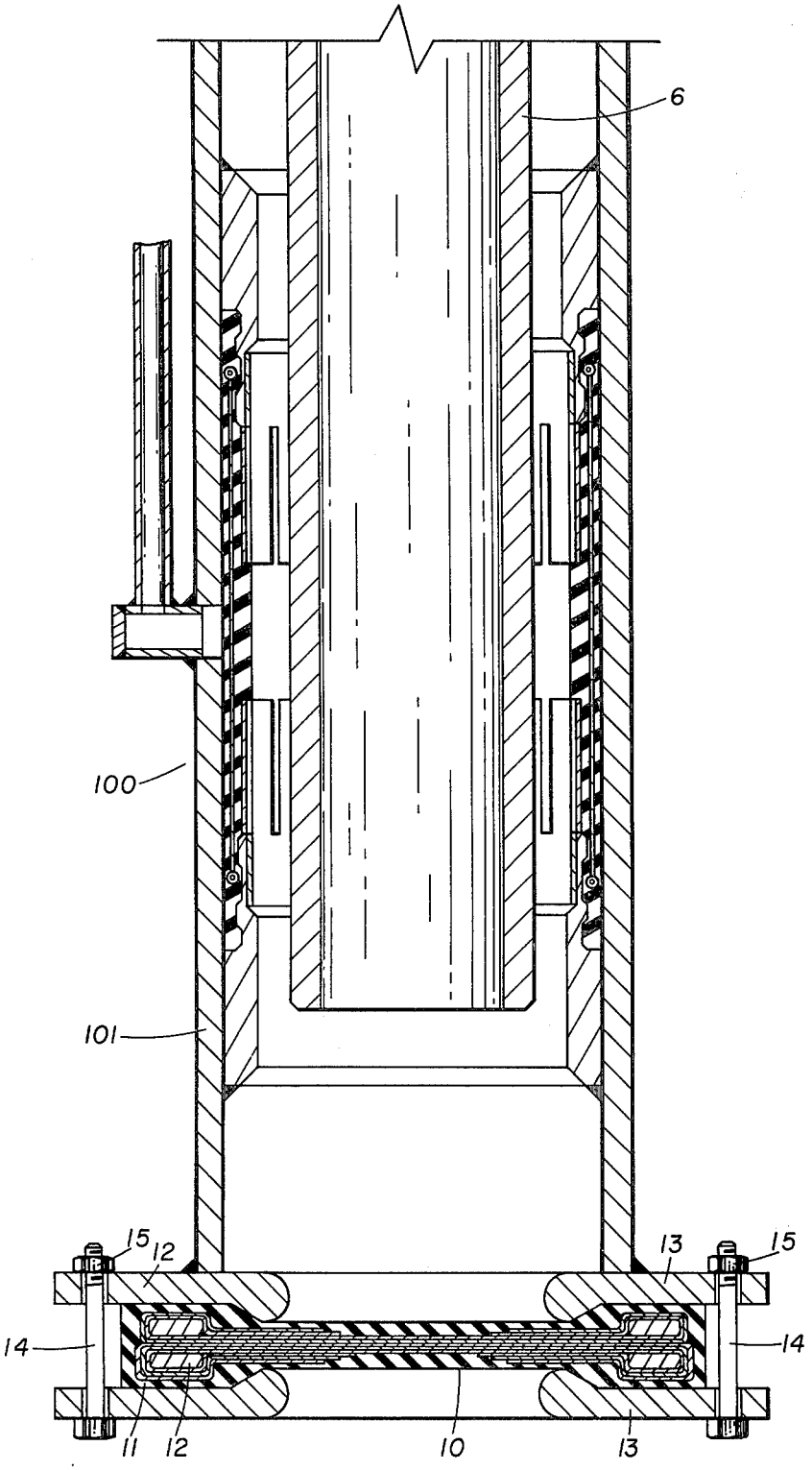
FIG. 2 is a cross-sectional view of the present invention in a typical installation in a leg or piling guide.

Referring to FIG. 2, the seal assembly 7 is shown in relation to an inflatable packer assembly 100 installed at the bottom of a leg 2 or guide 4. As shown, the diaphragm 10 is relatively thin compared to its diameter and has in its periphery 11 one or more metal reinforcing members 12.

For mounting the seal assembly 7 on the lower end of the inflatable packer assembly 100, a pair of flat, annular plates 13 is provided which are adapted to be detachably connected about their outer periphery by a plurality of bolts 14 and nuts 15. The upper annular plate 13 is adapted to be secured to the lower end of the packer housing 101 by welding, although any suitable means of securing the plate 13 may be used. If no inflatable packer is installed on the bottom of the leg 2 or guide 4, alternatively, the plate 13 may be secured to the bottom of the leg 2 or guide 4.

As shown, the seal assembly closes the lower end of the inflatable packer assembly 100 which is secured to a leg 2 or guide 4 through which piling is to be driven to facilitate floating of the platform to its point of installation as well as prevent entrance of slit and other debris into the leg 2 or guide 4 during the installation of the platform. To position the platform legs 2 and guides 4 on the bottom of the body of water, it is necessary to water flood some or all of the legs 2 and guides 4. After rupturing of the diaphragm 10 by the piling 6 being driven into the bottom, the diaphragm 10 and the water located thereabove acts to help prevent entry of foreign material into the leg 2 or guide 4, although during driving of the piling 6 an amount of foreign material will be introduced into the leg 2 or guide 4.

Figure 3:
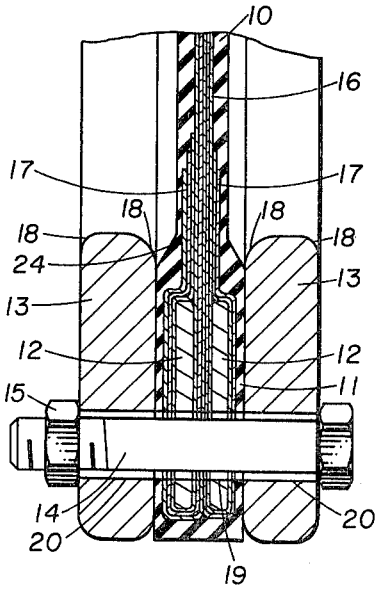
FIG. 3 is an enlarged broken cross-sectional view of a preferred embodiment of the present invention.

Referring to FIG. 3, a preferred embodiment of the diaphragm 10 is shown. The diaphragm 10 comprises a flexible member of rubber, synthetic rubber or other suitable elastomeric material. To reinforce the diaphragm 10, a plurality of layers 16 of fabric are bonded in the diaphragm 10 with the outer periphery of the layers 16 of fabric being wrapped and bonded to metal reinforcing members 12. Any number of layers of fabric may be used to reinforce the diaphragm 10 depending upon the desired strength of the diaphragm, although six (6) layers of fabric are shown. The layers 16 of fabric used to reinforce the diaphragm 10 may be of any suitable material, such as rayon, nylon, steel, a fabric sold under the trademark Kevlar by the Du Pont Company, etc., although nylon is preferred.

The metal reinforcing members 12 are formed having a generally rectangular cross-sectional configuration. Although the thickness of the metal reinforcing member 12 may vary, when considering the cross-sectional thickness of the member in proportion to the cross-sectional width of the member, the ratio of cross-sectional thickness to cross-sectional width of each member 12 should generally be in the range of 1:50 to 1:1, preferably in the range of 1:15 to 1:5, and most preferably approximately a 1:10 ratio. If the ratio of cross-sectional thickness to cross-sectional width of the metal reinforcing member 12 is greater than 1:50, such as 1:100, when the member 12 is highly stressed it will initially buckle inwardly causing a wrinkle in diaphragm 10, thereby allowing fluid to enter the leg 2 or guide 4 until the loading on the diaphragm 10 is sufficient to tear the layers 16 of fabric which causes massive failure of the diaphragm 10, not merely a leak between the annular flat plates 13. While the flat, annular plates 13 securely retain the periphery 11 of the diaphragm 10 having the metal reinforcing members 12 therein to generally prevent buckling of the members 12 under loading, since the diaphragm 10 deflects one of the plates 13 under loading, the periphery 11 of the diaphragm 10 under high loading will generally allow the members 12 to buckle, if not sufficiently strong.

Although the diaphragm 10 may be formed having a single metal reinforcing member 12 molded in the outer periphery 11 of the diaphragm 10 with the layers 16 of fabric wrapped and bonded thereto, it is preferable to use a plurality of metal reinforcing members 12 in the outer periphery 11 since a plurality of reinforcing members 12 provide a greater surface area for the bonding of the layers 16 of fabric to the reinforcing members 12. Although only two metal reinforcing members 12 have been shown in the outer periphery 11 of the diaphragm 10, any desired number may be used as long as sufficient strength is present in the outer periphery 11 of the diaphragm 10 to resist buckling under anticipated loading.

It should also be noted that it is important to have the ends 17 of the layers 16 of the fabric used to reinforce the diaphragm 10, which are wrapped and bonded to the metal reinforcing members 12, extend a distance into the inner portion of the diaphragm when they are bonded in position. When the diaphragm 10 is deflected by the force of the water, the inner portion of the outer periphery 11 contacts the inner radiused edge 18 of the annular flat plate 13 secured to the packer housing 101. By having the ends 17 of the layers 16 of the fabric reinforcing the diaphragm 10 terminating inwardly of the annular flat members 13 after they are wrapped and bonded to the metal reinforcing members 12, this acts as additional reinforcement for the diaphragm 10 to help prevent any failure of the diaphragm by tearing of the layers 16 of fabric at the outer periphery 11 of the diaphragm 10 which is retained between the annular flat plates 13.

It should be noted that the inner edges 18 of the annular flat plates 13 are radiused to provide a smooth bearing surface for the diaphragm 10 to bear against under loading.

The diaphragm 10 is positively held between the annular flat plates 13 by means of bolts 14 and nuts 15 extending therethrough. The diaphragm 10 is initially formed having the outer periphery 11 without bolt holes 19 therein as well as the annular flat plates 13 being initially formed without holes 20 therein to facilitate construction of both the diaphragm 10 and annular flat plates 13. After manufacture, the diaphragm 10 and flat annular plates 13 either have the holes 19 and 20, respectively, drilled therein or the diaphragm 10 is assembled between the pair of annular flat plates 13 and has the holes 19 and 20, respectively, drilled therein during a single drilling operation. The annular flat plates 13 may be formed having any desired cross-sectional thickness and cross-sectional width provided that the cross-sectional width is at least as great as the cross-sectional width of the metal reinforcing members 12 in the periphery 11 of the diaphragm 10.

Figure 4:
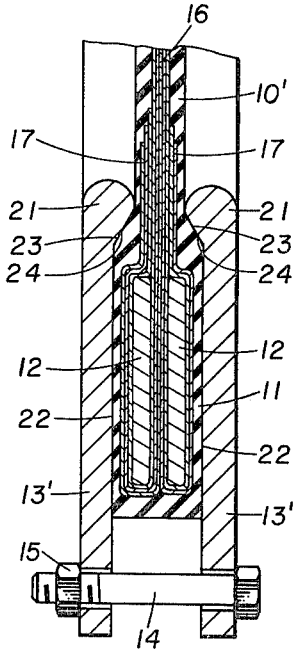
FIG. 4 is an enlarged broken cross-sectional view of an alternative preferred embodiment of the present invention.

Referring to FIG. 4, an alternative embodiment of the present invention is shown. The diaphragm 10' is identical to the diaphragm 10 shown in FIG. 3 except the diaphragm 10' contains no holes 19 therein. The annular flat plates 13' are formed having enlarged portions 21 thereon. The enlarged portions 21 on the annular flat plates 13' are formed by machining surfaces 22 of the annular flat plates 13' to have an angular surface 23 located thereon. The angular surface 23 on the annular flat plates 13' can be formed at any angle with respect to the surface 22, although a 15 degree angle is normally used. It should be noted that it is only necessary to provide a slight interference between the enlarged ends 21 of the annular flat plates 13' and the diaphragm 10' to retain the diaphragm 10' therein. It should also be noted that the angle on the angular surface 23 should match the angular surface 24 on the diaphragm 10'.

In this connection, as shown the diaphragms 10 and 10' are formed having the periphery 11 being thicker than the inner portion thereof to facilitate the driving of the piling therethrough. Although the diaphragms 10 and 10' could be formed having a constant thickness, the excess amount of elastic material in the inner portion of the diaphragm would offer increased resistance to the driving of a piling therethrough. Therefore, both diaphragms 10 and 10' are formed having outer periphery 11 being of greater thickness than the inner portion of the diaphragm with the angular surface 24 of each diaphragm defining the transitional portion of the diaphragm between the outer periphery 11 and inner portion.

It is to be clearly understood that the construction of diaphragms 10 and 10' is identical except diaphragm 10 has holes 19 therein to permit the diaphragm to be positively retained between flat annular plates by the use of fasteners.

From the foregoing it should be readily apparent that the present invention offers important advantages over the prior art.

The diaphragm is easily constructed using simple wrapping of the layers of fabric reinforcing the diaphragm around the metal reinforcing members in the outer periphery of the diaphragm.

The annular flat plates retaining the diaphragm have simple shapes requiring little machining for use.

The diaphragm is positively retained between the annular flat plates to prevent release therefrom.

The diaphragm is of a reinforced type capable of withstanding relatively high pressures over relatively large areas while remaining readily frangible by a piling driven therethrough without requiring the addition of cutting members in the diaphragm.

The metal reinforcing members in the periphery of the diaphragm are simple geometric shapes which can be easily constructed.

The diaphragm can be used with a variety of types of annular flat plates to retain the diaphragm on the leg or guide.

Having thus described my invention, I claim:

1. In combination, a diaphragm and annular diaphragm retaining means retaining said diaphragm therein, wherein said diaphragm comprises:

circular flexible member means having a peripheral portion and an inner portion;

annular reinforcing member means located in the peripheral portion of said circular flexible member means;

reinforcing means having a peripheral portion and an inner portion contained witnin said circular flexible member means, said reinforcing means having the inner portion thereof being disposed within the inner portion of said circular flexible member means, having the peripheral portion thereof being wrapped and secured to said annular reinforcing member means and having the peripheral portion of said reinforcing means terminating inwardly of said reinforcing member means and the inner diameter of said annular diaphragm retaining means wherein a portion of the peripheral portion of the reinforcing means overlays a portion of the inner portion of said reinforcing means.

2. The combination of claim 1 wherein:

said reinforcing means comprises a plurality of layers of reinforcing means; and said annular reinforcing member means comprises a plurality of annular reinforcing member means, each annular reinforcing member means of said plurality of annular reinforcing member means having at least one layer of said plurality of layers of reinforcing means being wrapped and secured thereto.

3. The combination of claim 2 wherein:

said plurality of layers of reinforcing means comprise a plurality of layers of fabric; and said plurality of reinforcing member means comprise a plurality of annular substantially rectangular cross-sectionally shaped reinforcing member means.

4. The combination of claim 3 wherein:

said diaphragm is retained by said diaphragm retaining means by means of a plurality of fasteners extending through said diaphragm retaining means, through said circular flexible member means, through said annular reinforcing member means of said diaphragm and through said reinforcing means of said diaphragm.

5. The combination of claim 3 wherein:

said diaphragm is retained by said diaphragm retaining means by means of an interference fit therein.

6. In combination, a diaphragm and an annular diaphragm retaining means retaining said diaphragm therein for closing the bore of a tubular support member of a marine platform or a similar structure, said diaphragm comprising:

circular flexible member means having a peripheral portion and an inner portion;

annular reinforcing member means located in the peripheral portion of said circular flexible member means;

reinforcing means having a peripheral portion and an inner portion contained within said circular flexible member means, said reinforcing means having the inner portion thereof being disposed within the inner portion of said circular flexible member means, having the peripheral portion thereof being wrapped and secured to said annular reinforcing member means and having the peripheral portion of said reinforcing means terminating inwardly of said reinforcing member means and the inner diameter of said annular diaphragm retaining means wherein a portion of the peripheral portion of the reinforcing means overlays a portion of the inner portion of said reinforcing means; and said annular diaphragm retaining means comprising:

a pair of annular plates releasably secured to each other retaining said diaphragm therebetween, said annular diaphragm retaining means having one of said pair of annular plates secured to the bottom of a tubular support member of said marine platform or said similar structure thereby closing said bore of said tubular support by said diaphragm and said diaphragm retaining means being installed thereon.

7. The combination of claim 6 wherein:

said reinforcing means comprises a plurality of layers of reinforcing means; and said annular reinforcing member means comprises a plurality of annular reinforcing member means, each annular reinforcing member means of said plurality of annular reinforcing member means having at least one layer of said plurality of reinforcing means being wrapped and secured thereto.

8. The combination of claim 7 wherein:

said plurality of layers of reinforcing means comprises a plurality of layers of fabric; and said plurality of annular reinforcing member means comprises a plurality of annular substantially rectangular cross-sectionally shaped reinforcing member means.

9. The combination of claim 8 wherein:

said pair of annular plates are releasably secured to each other by a plurality of fasteners extending through said pair of annular plates, through said flexible member means, through said reinforcing means of said diaphragm and through said reinforcing means of said diaphragm.

10. The combination of claim 8 wherein:

said pair of annular plates are releasably secured to each other by a plurality of fasteners extending through said pair of annular plates while said diaphragm is retained between said pair of annular plates by means of an interference fit.

11. In combination, a diaphragm and an annular diaphragm retaining means retaining said diaphragm therein for closing the bore of a tubular support member of a marine platform or a similar structure, said diaphragm comprising:

circular flexible member means having a peripheral portion and an inner portion;

annular reinforcing member means located in the peripheral portion of said circular flexible member means;

reinforcing means having a peripheral portion and an inner portion contained within said circular flexible member means, said reinforcing means having the inner portion thereof being disposed within the inner portion of said circular flexible member means, having the peripheral portion thereof being wrapped and secured to said annular reinforcing member means and having the peripheral portion of said reinforcing means terminating inwardly of said reinforcing member means and the inner diameter of said annular diaphragm retaining means wherein a portion of the peripheral portion of the reinforcing means overlays a portion of the inner portion of said reinforcing means; and said annular diaphragm retaining means comprising:

a pair of annular plates releasably secured to each other by a plurality of fasteners extending through said pair of annular plates, through said circular flexible member means, through said reinforcing member means of said diaphragm and through said reinforcing means of said diaphragm, said annular diaphragm retaining means having one of said pair of annular plates secured to the bottom of a tubular support member of said marine platform or said similar structure thereby closing said bore of said tubular support by said diaphragm and said diaphragm retaining means being installed thereon.

12. In combination, a diaphragm and an annular diaphragm retaining means retaining said diaphragm therein for closing the bore of a tubular support member of a marine platform or a similar structure, said diaphragm comprising:

circular flexible member means having a peripheral portion and an inner portion;

annular reinforcing member means located in the peripheral portion of said circular flexible member means;

reinforcing means having a peripheral portion and an inner portion contained within said circular flexible member means, said reinforcing means having the inner portion thereof being disposed within the inner portion of said circular flexible member means, having the peripheral portion thereof being wrapped and secured to said annular reinforcing member means and having the peripheral portion of said reinforcing means terminating inwardly of said reinforcing member means and the inner diameter of said annular diaphragm retaining means wherein a portion of the peripheral portion of the reinforcing means overlays a portion of the inner portion of said reinforcing means; and said annular diaphragm retaining means comprising:

a pair of annular plates releasably secured to each other by a plurality of fasteners extending through said pair of annular plates while said diaphragm is retained between said pair of annular plates by means of an interference fit, said annular diaphragm retaining means having one of said pair of annular plates connected to the bottom of a tubular support member of said marine platform or said similar structure thereby closing said bore of said tubular support by said diaphragm and said diaphragm retaining means being installed thereon.

* * * * *